US006648283B2

(12) United States Patent
Chase et al.

(10) Patent No.: US 6,648,283 B2
(45) Date of Patent: Nov. 18, 2003

(54) ADJUSTABLE ORNAMENT DISPLAY APPARATUS

(76) Inventors: Joanne M. Chase, 4693 Indiana, Ottawa, KS (US) 66067; Warren Chase, 4693 Indiana, Ottawa, KS (US) 66067

( * ) Notice: Subject to any disclaimer, the term of this patent is extended or adjusted under 35 U.S.C. 154(b) by 174 days.

(21) Appl. No.: 09/900,109

(22) Filed: Jul. 6, 2001

(65) Prior Publication Data

US 2003/0006348 A1 Jan. 9, 2003

(51) Int. Cl.[7] ..... A47F 5/00; A47F 7/00; F16M 13/00

(52) U.S. Cl. ..... 248/125.1; 248/125.3; 248/158; 211/13.1; 211/85.2; 211/85.3; 40/607; 40/608; 40/657

(58) Field of Search ..... 248/125.1, 125.3, 248/220.43, 158, 221.11, 222.12, 220.21, 220.22, 220.41, 225.11, 225.21, 122.1, 126, 125.8; 211/13.1, 85.2, 85.3, 205, 207, 70.1, 85.26, 163; 40/607, 608, 657

(56) References Cited

U.S. PATENT DOCUMENTS

| | | | | | |
|---|---|---|---|---|---|
| 1,801,058 | A | * | 4/1931 | Sutcliffe | 211/163 |
| 2,923,417 | A | * | 2/1960 | Sonksen | 211/165 |
| 2,950,011 | A | * | 8/1960 | Hemphill | 211/1 |
| 3,092,258 | A | * | 6/1963 | Bleed | 211/163 |
| 3,739,919 | A | * | 6/1973 | Hochman | 248/220.43 |
| 3,756,421 | A | * | 9/1973 | Wilkins | 211/163 |
| 4,300,300 | A | | 11/1981 | Neuland et al. | |
| 4,699,346 | A | | 10/1987 | Bahm | |
| 4,815,612 | A | * | 3/1989 | Leo, Sr. | 211/189 |
| 4,971,284 | A | | 11/1990 | Curry | |
| 5,083,737 | A | | 1/1992 | Rifkin | |
| 5,338,585 | A | | 8/1994 | Fraus et al. | |
| 5,492,476 | A | | 2/1996 | Ball et al. | |
| 5,518,217 | A | | 5/1996 | Deutsch et al. | |
| 5,560,575 | A | * | 10/1996 | Krysiak | 248/222.12 |
| D427,935 | S | * | 7/2000 | Anderson et al. | D11/118 |

* cited by examiner

*Primary Examiner*—Kimberly Wood
(74) *Attorney, Agent, or Firm*—Dale J. Ream

(57) ABSTRACT

An adjustable ornamental display apparatus includes a base with an upstanding support post releasably received therein. A mounting bracket having a pair of mounting arms is attached to an upper end of the support post. The apparatus includes a display board having front and back panels and having a configuration indicative of a festive occasion. The back panel defines a plurality of vertically spaced slots in parallel series, each slot having a configuration complementary to that of the mounting arms such that the display board may be coupled to the support post at selectable vertical positions through a mating relationship between selected slots and the mounting arms. The front panel defines a plurality of holes with each hole being initially covered with a perforated material that may be selectively punctured by rearwardly extending prongs of hanger brackets. The brackets are adapted to support ornaments corresponding to the festive occasion.

6 Claims, 6 Drawing Sheets

ADJUSTABLE ORNAMENT DISPLAY APPARATUS

BACKGROUND OF THE INVENTION

This invention relates generally to ornamental displays and, more particularly, to an ornament display apparatus having a configuration indicative of a recognizable festive occasion that is vertically adjustable and allows ornaments to be displayed that are indicative of the festive occasion.

It is traditional and desirable to hang Christmas stockings from the mantle of a fireplace during the Christmas holiday season. Other ornaments associated with this season are also frequently displayed. However, a fireplace is not found in every home today in contrast to home construction in days gone by. Thus, a mantle from which to hang stockings is often unavailable. Of course, decorations relevant to other seasons, holidays, or festive events are also frequently displayed at relevant times and may experience the same dilemma of not having an adequate display apparatus.

Various devices have been proposed in the art for hanging ornaments from a wall or for holding art supplies and the like. Although assumably effective for their intended purposes, the existing devices do not provide a vertically adjustable apparatus indicative of a festive occasion that allows selectable positioning of multiple ornament hangers.

Therefore, it is desirable to have an ornament display apparatus in which a display board is configured to be indicative of a recognizable festive occasion. Further, it is desirable to have an ornament display apparatus in which the display board is selectably vertically adjustable. Finally, it is desirable to have an ornament display apparatus in which ornament hangers may be selectively positioned on the display board.

SUMMARY OF THE INVENTION

An adjustable ornament display apparatus according to the present invention includes a base with an elongate support post releasably mounted in the base in an upstanding configuration. The display apparatus further includes a display board having a front panel connected to a back panel with both panels having a configuration indicative of a recognizable festive occasion. For example, the display board may be in the shape of a Christmas tree, Christmas bell, package, star, stocking, ornament or other configuration relevant to other holidays, events, or occasions.

A mounting bracket having a pair of mounting arms is attached to the top of the support post. The back panel of the display board defines first and second series of vertically spaced apart slots, the second series being parallel to the first series. The front and back panels are slightly separated from one another at respective portions adjacent the slots such that the mounting arms of the mounting bracket may be inserted into a selected pair of slots, the tip of each mounting arm being received in the space between the front and back panels. Therefore, the display board may be vertically positioned along the support post at a selectable height. A post clamp attached to the rear panel may also be engaged by the support post to releasably secure the display board to the post.

The front panel of the display board defines a plurality of holes that are initially covered in a perforated manner. Hanger brackets having rearwardly extending prongs may be inserted into selected holes, thereby puncturing the perforated material and being coupled in a respective hole. The hanger brackets have a generally U-shaped configuration for receiving hanging-type ornaments thereon.

Therefore, a general object of this invention is to provide an ornament display apparatus having a display board which visually identifies a particular holiday or other festive occasion.

Another object of this invention is to provide an ornament display apparatus, as aforesaid, in which the display board is vertically adjustable to a desired height relative to a support post.

Still another object of this invention is to provide an ornament display apparatus, as aforesaid, on which multiple ornaments may be selectively positioned for display.

Yet another object of this invention is to provide an ornament display apparatus, as aforesaid, that is easy to assemble and disassemble for set-up and storage.

A further object of this invention is to provide an ornament display apparatus, as aforesaid, having a pedestal for stable mounting a display board and support post.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

An adjustable ornament display apparatus according to the present invention will now be described in detail with reference to FIGS. 1 through 11 of the accompanying drawings.

Figure 2:
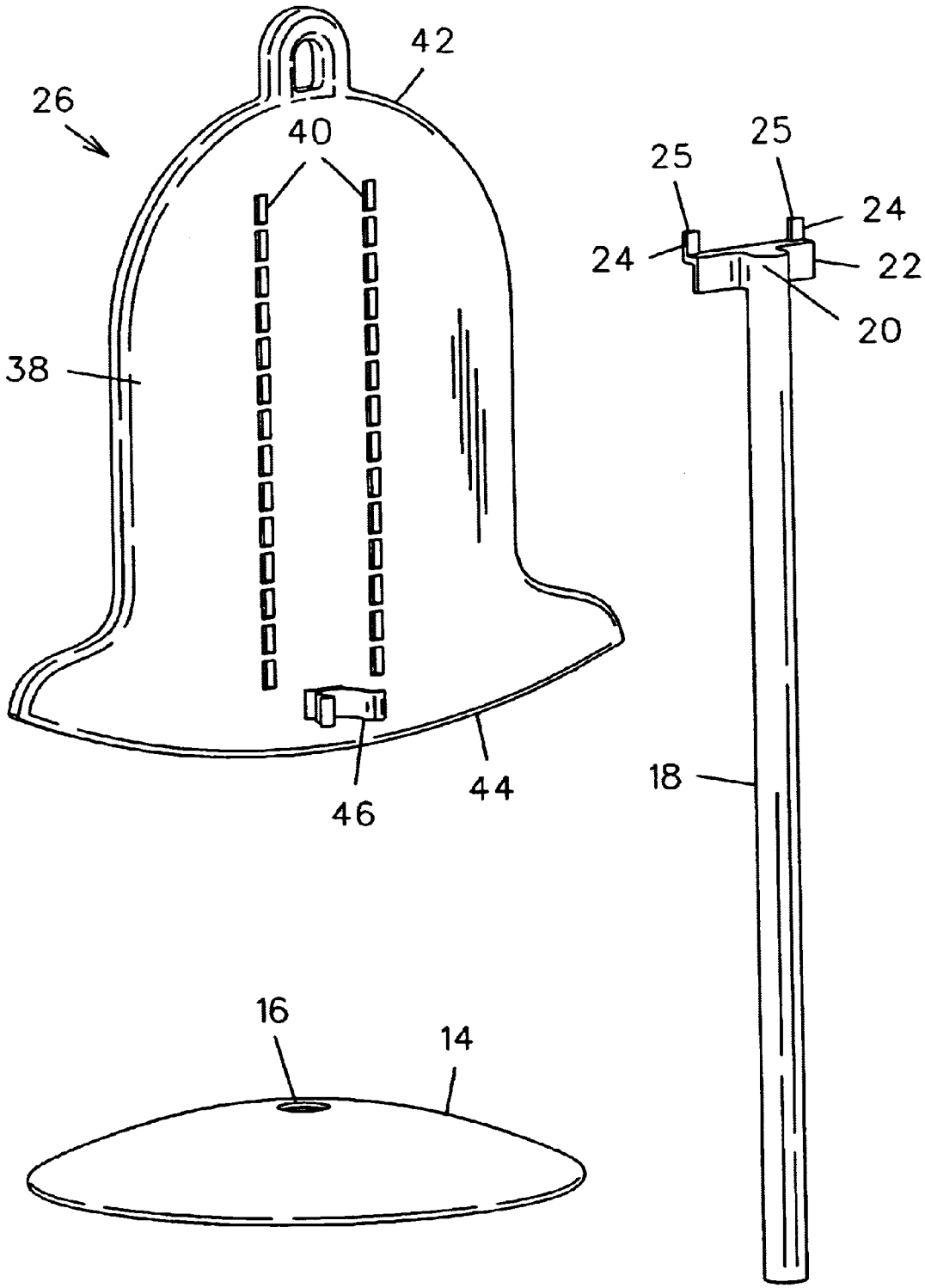
FIG. 2 is another perspective view of the display apparatus as in FIG. 1 in a disassembled configuration.

An adjustable ornament display apparatus 10 according to one embodiment of the invention includes a base 14 having a disk-shaped, upwardly convex configuration (FIG. 2). The base 14 defines a bore 16 through the radial center thereof for receiving a support post 18, as to be described more fully below. Preferably, the bore 16 is dimensioned to receive a post in a friction fit relationship although the bore 16 and post may also include complementary threads that enable the post to be threadably coupled to the base 14. The apparatus 10 includes an elongate support post 18 dimensioned to be removably received in the bore 16 of the base 14. Preferably, the support post 18 and bore 16 are cylindrical although other configurations would also work. When properly secured in the bore 16, the support post extends upwardly from the base 14 in an upright vertical configuration. A mounting bracket 22 is fixedly attached to an upper end 20 of the support post 18 (FIG. 2). The mounting bracket 22 includes a pair of spaced apart mounting arms 24 having tips 25 that are laterally spaced apart and parallel to one another.

Figure 1:
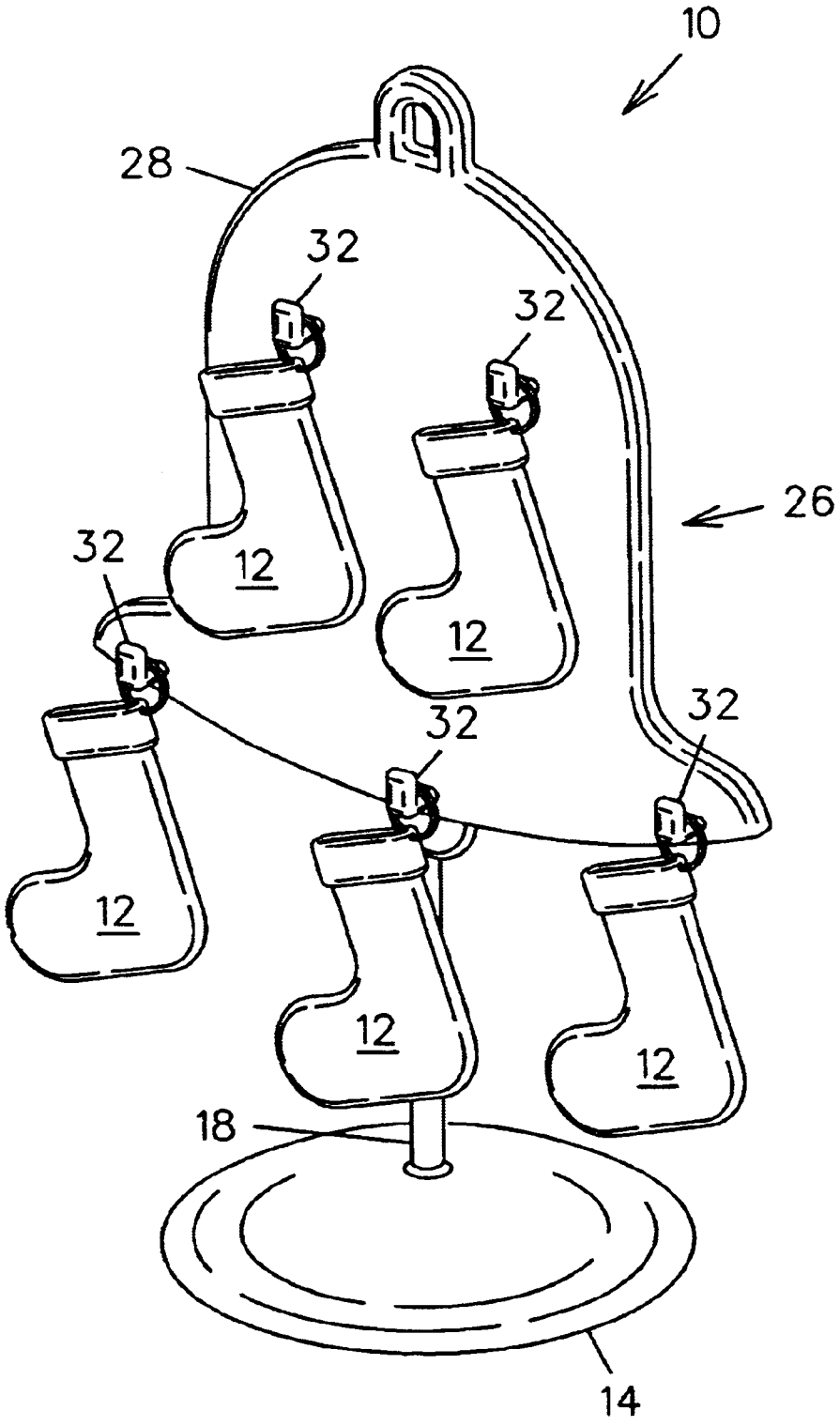
FIG. 1 is a perspective view of an adjustable ornament display apparatus according to one embodiment of the present invention.
Figure 3:
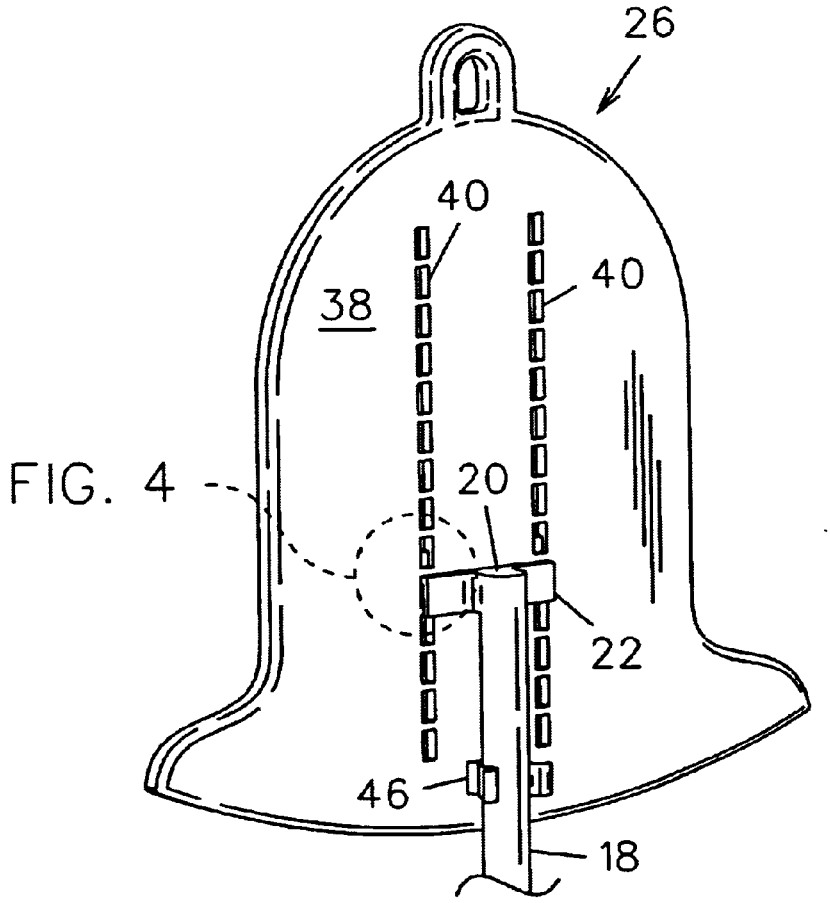
FIG. 3 is a fragmentary rear perspective view of the display apparatus as in FIG. 1.
Figure 4:
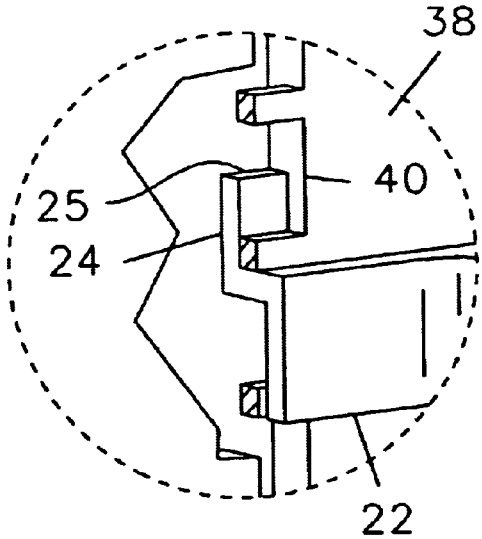
FIG. 4 is an isolated perspective view as in FIG. 3 on an enlarged scale and with a portion of the display board broken away so as to show a mounting arm coupled to the display board.
Figure 5:
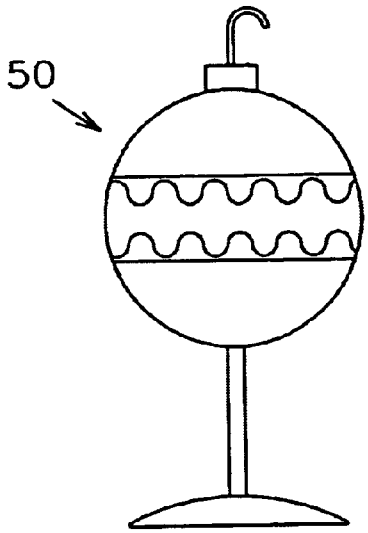
FIG. 5 is a front view on a reduced scale of another embodiment of the ornament display apparatus according to the present invention.
Figure 6:
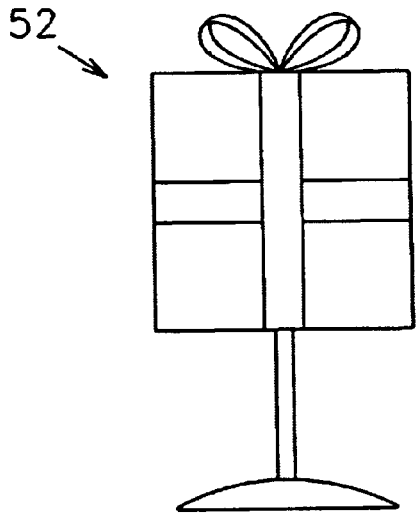
FIG. 6 is a front view on a reduced scale of still another embodiment of the ornament display apparatus according to the present invention.
Figure 7:
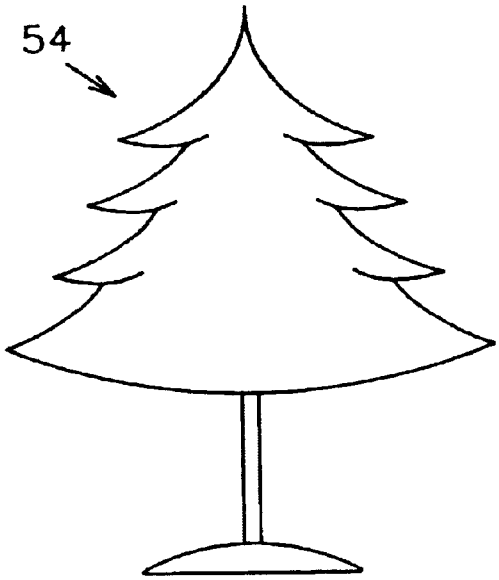
FIG. 7 is a front view on a reduced scale of still another embodiment of the ornament display apparatus according to the present invention.
Figure 8:
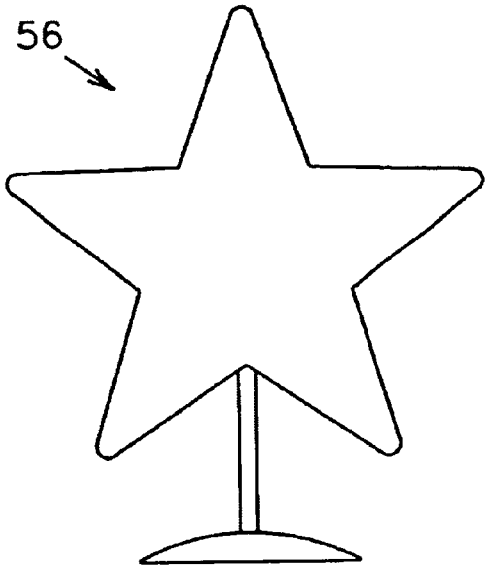
FIG. 8 is a front view on a reduced scale of yet another embodiment of the ornament display apparatus according to the present invention.

The display apparatus 10 further includes a display board 26 having a front panel 28 connected to a back panel 38 (FIGS. 1 and 2). The panels may be constructed of a rigid plastic material. Preferably, the front 28 and back 38 panels have a substantially similar configuration in a form that is immediately indicative of a recognized festive occasion such as Christmas. However, it would also be suitable for only the front panel 28 to have a recognizable festive configuration. As shown in FIG. 1, the display board 26 may include a configuration in the form of a Christmas bell. Portions of the front 28 and back 38 panels are spaced apart from one another to form a space therebetween. It is understood that the display board 26 may be completely hollow or may include a honeycomb construction that is more rigid. The portion of the back panel 38 that is spaced from the front panel 28 defines first and second series of hanging slots 40 (FIG. 3). The first and second series of slots 40 are laterally spaced apart and parallel to one another. The slots 40 within a series are vertically spaced apart between top 42 and bottom 44 edges of the back panel 38. Each slot 40 includes a configuration and is dimensioned complementary to a respective mounting arm 24 of the mounting bracket 22 such that the tips 25 of respective mounting arms 24 may be inserted into selectable slots 40. This enables the display board 26 to be vertically positioned along the support post 18 at a desired height relative to a ground surface. The tip 25 of each mounting arm 24 is received within the space defined between the front 28 and back 38 panels (FIG. 4). It should be appreciated that a single series of vertically spaced slots and a mounting bracket having a single mounting arm would also be suitable.

At least one post clamp 46 is fixedly attached to the back panel 38 (FIG. 4). Each post clamp 46 includes a pair of resilient arms that are biased toward one another and may be pressed apart by the support post 18 as the post 18 and clamp 46 are selectively releasably coupled together by a user (FIG. 3).

Figure 9:
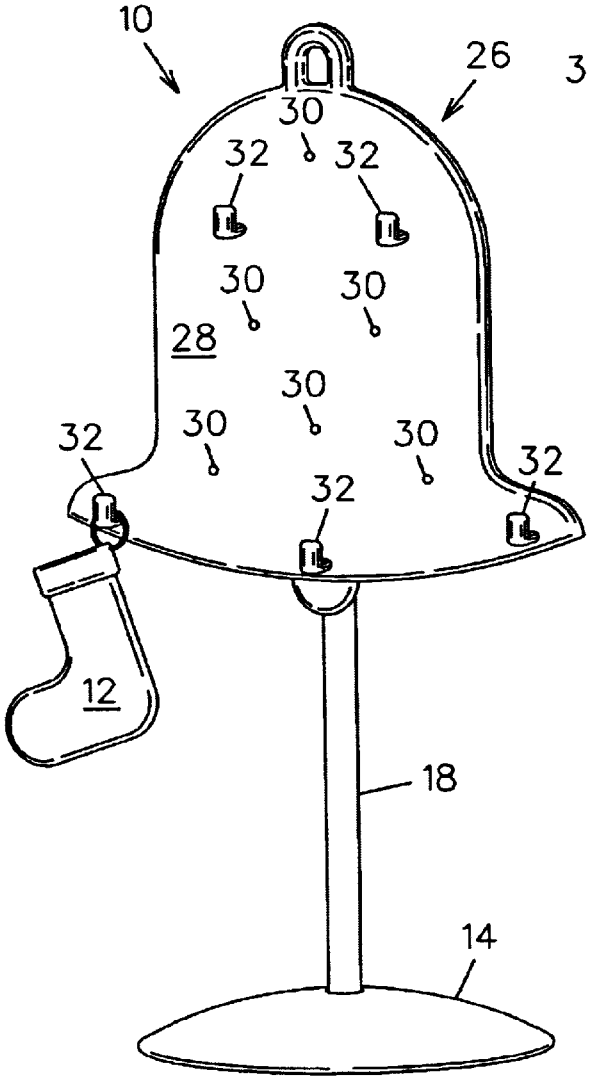
FIG. 9 is another perspective view of the apparatus as in FIG. 1 with hanging brackets mounted in selected holes on the display board.
Figure 10A:
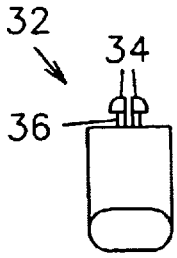
FIG. 10*a* is a top view of a hanger bracket as in FIG. 9.
Figure 10B:
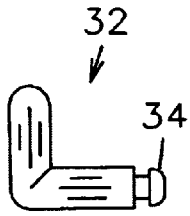
FIG. 10*b* is a side view of a hanger bracket as in FIG. 9.

As shown with particularity in FIG. 9, the front panel 28 of the display board 26 defines a plurality of holes 30 spaced apart in a predetermined configuration. Each hole 30 is initially covered with a material that is easily punctured, such as cardboard or a thin plastic layer, the cover material being perforated. The display apparatus 10 includes a plurality of L-shaped hanger brackets 32 with each bracket 32 having a pair of prongs 34 extending rearwardly from a rear end thereof. Each pair of prongs 34 are biased away from one another and include a stop 36 such that said prongs are retained within a respective hole 30 upon insertion therein. Ornaments or other decorations, therefore, may be hung from hanger brackets 32 positioned at selected locations on the front panel 28.

In use, the adjustable ornament display apparatus 10 may be assembled by inserting the support post 18 into the bore 16 defined by the base 14 where the support post 18 is frictionally held in an upright configuration. The display board 26 may then be positioned at a selected vertical position along the support post 18 by inserting the mounting arms 24 of the mounting bracket 22 into a selected pair of slots 40 (FIGS. 3 and 4). The post clamp 46 may also be engaged by the support post 18 for more stability. Hanger brackets 32 may be inserted into selected holes 30 on the front panel 28 by puncturing the perforations with respective hanger prongs 34. It is understood that the pair of prongs may need to be compressed together somewhat to fit through a hole, the hanger bracket 32 being secured therein as the prongs return to their normal configuration. Then, selected decorations 12 may be coupled or hung from the hanger brackets 32. When desired, the display board 26 may be removed from the support post 18 and the support post 18 may be frictionally released from the base 14 for storage.

Other embodiments of the display apparatus are shown in FIGS. 5 through 8 with each embodiment having a construction that is substantially similar to that described above except as specifically noted below. In the FIG. 5 embodiment 50, the display board has a configuration in the shape of a Christmas ornament. In the FIG. 6 embodiment 52, the display board has a configuration in the shape of a wrapped Christmas present. In the FIG. 7 embodiment 54, the display board has a configuration in the form of a Christmas tree. In the FIG. 8 embodiment 56, the display board has a configuration in the form of five-point star.

Figure 11:
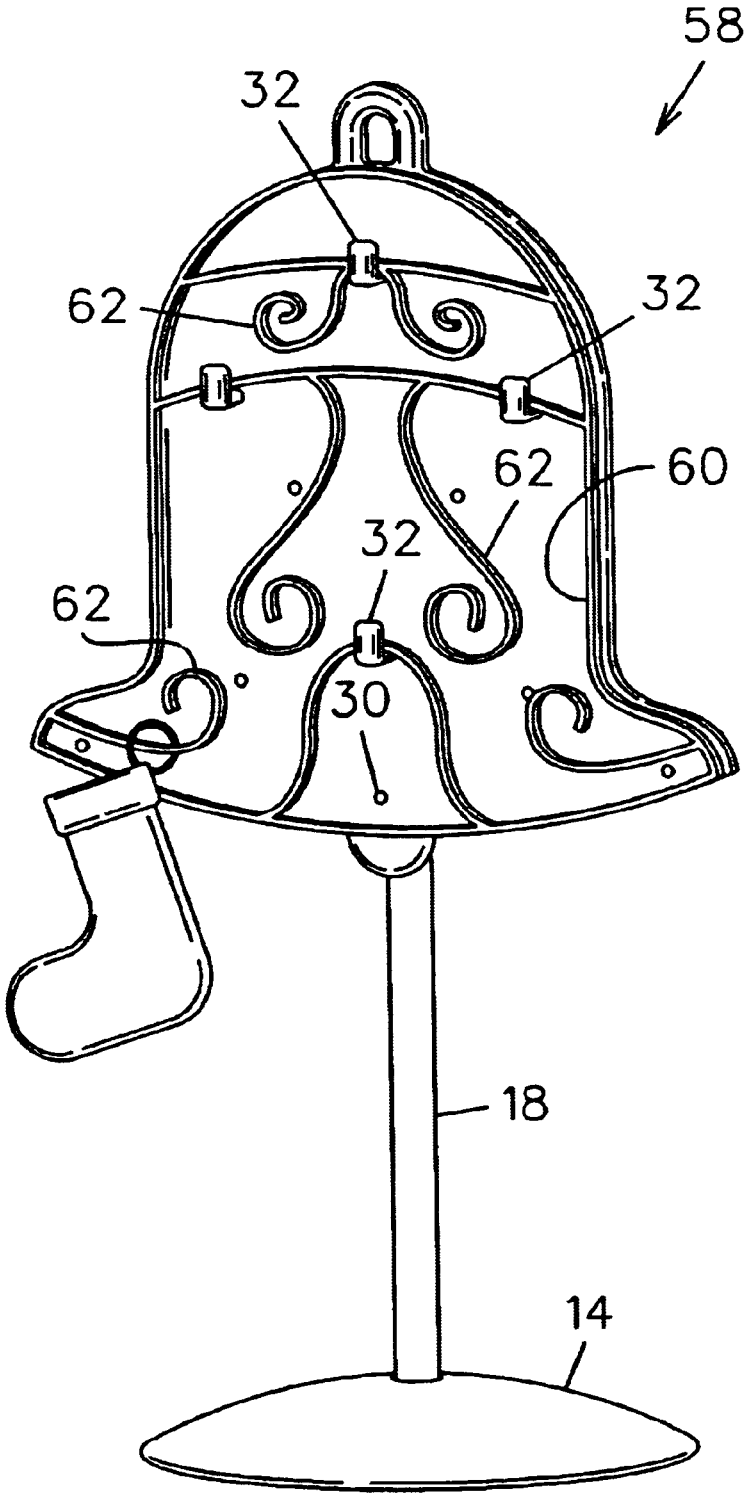
FIG. 11 is a front view of still another embodiment of the ornament display apparatus according to the present invention.

FIG. 11 shows yet another embodiment 58 of a display apparatus according to the present invention. This embodiment 58 also has a construction substantially similar to the construction first described above. This embodiment 58 includes a simulated wrought iron overlay 60 that may be hung from a hanger bracket 32 coupled to the display board. The overlay 60 includes a plurality of ornamentally-shaped arms 62 to which decorations 12 may be attached.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An adjustable ornamental display apparatus, comprising:

an elongate support post;

a base having a disk-shaped configuration and defining a bore at a radial center thereof for receiving said support post in an upstanding configuration;

a display board having a front panel and a back panel with a configuration indicative of a recognized festive occasion, said back panel having top and bottom edges and defining a plurality of slots vertically spaced between said top and bottom edges;

a mounting bracket fixedly attached to said support post and having at least one mounting arm adapted to releasably mate with a respective slot for selectively positioning said display board along said support post;

at least one post clamp attached to said back panel of said display board and adapted to releasably couple said display board to said support post; and means for hanging ornaments indicative of said recognized festive occasion at selected locations on said front panel of said display board.

2. The ornamental display apparatus as in claim 1 wherein said recognized festive occasion is Christmas.

3. The ornamental display apparatus as in claim 1 wherein:

said hanging means includes a plurality of L-shaped hanger brackets, each bracket having a pair of resilient prongs biased away from one another; and said front panel of said display board defines a plurality of holes, each hole being initially covered with a perforated material that may be selectively punctured by a respective pair of prongs of a hanger bracket such that said respective pair of prongs mates with a respective hole.

4. The ornamental display apparatus as in claim 1 wherein said front panel and said back panel have substantially the same configuration.

5. The ornamental display apparatus as in claim 1 wherein a portion of said front panel is spaced apart from a portion of said back panel, whereby a tip of said mounting bracket is received into a space between respective spaced apart portions of said front and back panels when said mounting bracket is coupled with a respective slot.

6. The ornamental display apparatus as in claim 5 wherein:

said plurality of slots includes a first series of slots vertically spaced apart along said portion of said back panel and a second series of slots vertically spaced apart along said portion of said back panel, said second series of slots being parallel to said first series of slots; and wherein said at least one mounting arm of said mounting bracket includes a first bracket arm laterally spaced from a second bracket arm such that said first and second bracket arms may be selectively coupled to a respective pair of slots of said first and second series of slots.

* * * * *